US010571848B2

(12) United States Patent
Tanaka

(10) Patent No.: US 10,571,848 B2
(45) Date of Patent: Feb. 25, 2020

(54) FEEDING APPARATUS AND METHOD OF CONTROLLING THE SAME

(71) Applicant: CANON FINETECH NISCA INC., Misato-shi (JP)

(72) Inventor: Yutaka Tanaka, Fuefuki (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/895,315

(22) Filed: Feb. 13, 2018

(65) Prior Publication Data

US 2018/0239291 A1 Aug. 23, 2018

(30) Foreign Application Priority Data

Feb. 23, 2017 (JP) ..... 2017-032506
Feb. 5, 2018 (JP) ..... 2018-018507

(51) Int. Cl.
*B65H 3/14* (2006.01)
*G03G 15/00* (2006.01)
(Continued)

(52) U.S. Cl.
CPC ..... *G03G 15/6511* (2013.01); *B65H 3/14* (2013.01); *B65H 3/48* (2013.01); *B65H 5/06* (2013.01);
(Continued)

(58) Field of Classification Search
CPC .... B65H 3/48; B65H 3/14; B65H 2406/1222; B65H 2406/12
See application file for complete search history.

(56) References Cited

U.S. PATENT DOCUMENTS 6,015,144 A * 1/2000 Yoshii ..... B65H 3/48 271/97
7,419,152 B2 * 9/2008 Adachi ..... B65H 3/48 271/31
(Continued)

FOREIGN PATENT DOCUMENTS

JP 2006-008380 A 1/2006
JP 2006-193262 A 7/2006
(Continued)

OTHER PUBLICATIONS

Extended European Search Report dated Jul. 12, 2018, in European Patent Application No. 18156396.6.
(Continued)

*Primary Examiner* — Luis A Gonzalez
(74) *Attorney, Agent, or Firm* — Venable LLP

(57) ABSTRACT

A feeding apparatus comprises a blower unit that is able to perform a first air blowing operation on sheets which are stacked on a stacking unit, and a second air blowing operation in which the volume of air blowing is smaller than volume of air blowing in the first air blowing operation; a feeding unit, brought into contact with the sheets stacked on the stacking unit and located on a feeding position to which feeding is performed while pressing the sheets from above, for feeding the sheets on which the first air blowing operation has been performed; and a control unit for controlling the blower unit to perform the first air blowing operation until a start of feeding by the feeding unit so as to separate the sheets stacked on the stacking unit.

9 Claims, 6 Drawing Sheets

FIG. 2

(51) Int. Cl.
*B65H 7/16* (2006.01)
*B65H 5/06* (2006.01)
*B65H 3/48* (2006.01)

(52) U.S. Cl.
CPC ..... *B65H 7/16* (2013.01); *G03G 15/6558* (2013.01); *B65H 2406/1222* (2013.01); *G03G 2215/00396* (2013.01); *G03G 2215/00556* (2013.01); *G03G 2221/1645* (2013.01)

(56) References Cited

U.S. PATENT DOCUMENTS 8,113,501 B2 2/2012 Uji et al.
8,444,138 B2 * 5/2013 Taki ..... B65H 3/128 271/105
9,802,775 B2 * 10/2017 Hashimoto ..... B65H 7/02
10,144,601 B2 * 12/2018 Masuda ..... B65H 3/0684
2005/0285326 A1 * 12/2005 Uji ..... B65H 3/48 271/97
2008/0237968 A1 * 10/2008 Suzuki ..... B65H 3/128 271/98
2008/0290589 A1 11/2008 Uji et al.
2009/0066008 A1 3/2009 Hirose et al.
2010/0148425 A1 6/2010 Kosugi et al.
2013/0087967 A1 * 4/2013 Fuda ..... B65H 1/04 271/97
2014/0061999 A1 3/2014 Okamoto
2016/0167905 A1 6/2016 Enomoto
2018/0150006 A1 * 5/2018 Furuichi ..... G03G 15/6511

FOREIGN PATENT DOCUMENTS

JP 2006-248674 A 9/2006
JP 2014-001061 A 1/2014
JP 2017100844 A * 6/2017

OTHER PUBLICATIONS

Office Action dated Jan. 25, 2019, in Japanese Patent Application No. 2018-018507.

* cited by examiner

FEEDING APPARATUS AND METHOD OF CONTROLLING THE SAME

BACKGROUND OF THE INVENTION

Field of the Invention

The present invention relates to a feeding apparatus, and a method of controlling the same.

Description of the Related Art

Conventionally, an image forming apparatus such as a printer or a copying machine includes an internal or external feeding apparatus configured to convey sheets stacked on a stack tray separately one by one. This feeding apparatus includes a vertically movable stack tray on which the sheets are stacked, a pickup unit that contacts the upper surface of the sheet to pick up the sheets, a separating and feeding unit that separates the picked up sheets one by one to feed them, and a conveyance unit that conveys the separated sheets.

A separating and feeding unit of a frictional separation system that includes a feeding roller which feeds sheets, and a separation member which includes a separation pad, a separation roller, or the like abutting against the outer surface of the feeding roller is known as the separating and feeding unit. In this frictional separation system, the surfaces of the feeding roller and the separation member are worn due to changes over time and contact with the sheets, degrading sheet separation performance. Such degradation in separation performance frequently causes double feed in which two or more sheets are fed overlapping each other.

As a means for preventing occurrence of a feeding failure of the sheets owing to double feed or the like, there is a feeding apparatus that incorporates an air blowing mechanism for canceling a tight contact state among the sheets by blowing a predetermined volume of air to a sheet bundle on the stack tray. For example, a feeding apparatus in Japanese Patent Laid-Open No. 2014-1061 detects a sheet separated and conveyed by air at a predetermined position, calculates a feeding time from feeding start time to sheet detection time, and controls the volume of at least one of side-end air and front-end air.

In Japanese Patent Laid-Open No. 2014-1061, however, it may be impossible to cope with early feeding and implement stable feeding because, for example, a detection count of a feeding time exceeding 80% of a jam detection time is measured to compare the detection count and a threshold, and an air volume is increased or decreased based on the comparison.

It is therefore impossible to control the behavior of a floating sheet in air blowing control of the conventional feeding apparatus, making it difficult to stabilize the sheet in both states before and after the start of feeding. A floating position or floating amount of the sheet changes depending on its size, and thus a succeeding sheet also floats and is conveyed together with a fed and conveyed sheet even with a predetermined air volume, making it impossible to implement stable feeding and conveyance.

SUMMARY OF THE INVENTION

According to the present invention, it is possible to stabilize the behavior of a sheet at the time of feeding while ensuring sheet separation performance before feeding.

According to one aspect of the present invention, there is provided a feeding apparatus comprising: a stacking unit for stacking sheets; a blower unit that is able to perform a first air blowing operation on the sheets which are stacked on the stacking unit, and a second air blowing operation in which the volume of air blowing is smaller than volume of air blowing in the first air blowing operation; a feeding unit, brought into contact with the sheets stacked on the stacking unit and located on a feeding position to which feeding is performed while pressing the sheets from above, for feeding the sheets on which the first air blowing operation has been performed; a conveyance unit, provided on a downstream side of the feeding unit in a feeding direction, for conveying the sheets fed by the feeding unit; and a control unit for controlling the blower unit to perform the first air blowing operation until a start of feeding by the feeding unit so as to separate the sheets stacked on the stacking unit, and to perform the second air blowing operation that acts on the feeding position during a period from a start of feeding by the feeding unit to reaching of the sheets to the conveyance unit when the feeding unit feeds the sheets.

According to another aspect of the present invention, there is provided a feeding apparatus comprising: a stacking unit for stacking sheets; a separation unit for performing an air blowing operation on the sheets so as to separate the sheets from each other; a feeding unit, brought into contact with the sheets stacked on the stacking unit and located on a feeding position to which feeding is performed while pressing the sheets from above, for feeding the sheets on which the air blowing operation has been performed; a conveyance unit, provided on a downstream side of the feeding unit in a feeding direction, for conveying the sheets fed by the feeding unit; and a control unit for performing control so as to stop an air blowing operation of the separation unit such that air blowing by the air blowing operation of the separation unit does not act on the feeding position during a period from a start of feeding by the feeding unit to reaching of the sheets to the conveyance unit when the feeding unit feeds the sheets.

According to another aspect of the present invention, there is provided a feeding apparatus comprising: a stacking unit for stacking sheets; a separation unit for performing an air blowing operation on the sheets so as to separate the sheets from each other; a feeding unit, brought into contact with the sheets stacked on the stacking unit and located on a feeding position to which feeding is performed while pressing the sheets from above, for feeding the sheets on which the air blowing operation has been performed; a conveyance unit, provided on a downstream side of the feeding unit in a feeding direction, for conveying the sheets fed by the feeding unit; a shielding unit for shielding air blowing by the air blowing operation of the separation unit; and a control unit for performing control so as to shield air blowing by the shielding unit such that air blowing by the air blowing operation of the separation unit does not act on the feeding position during a period from a start of feeding by the feeding unit to reaching of the sheets to the conveyance unit when the feeding unit feeds the sheets.

According to another aspect of the present invention, there is provided a method of controlling a feeding apparatus that performs a first air blowing operation on sheets which are stacked on a stacking unit, and a second air blowing operation in which a volume of air blowing is smaller than volume of air blowing in the first air blowing operation by a blower unit, and then feeds the sheets on which the first air blowing operation has been performed by a feeding unit brought into contact with the sheets located on a feeding position to which feeding is performed while pressing the sheets from above, the method comprising: controlling the blower unit to perform the first air blowing operation until a start of feeding by the feeding unit so as to separate the sheets stacked on the stacking unit, and to perform the second air blowing operation that acts on the feeding position during a period from a start of feeding by the feeding unit to reaching of the sheets to a conveyance unit when the feeding unit feeds the sheets.

According to another aspect of the present invention, there is provided a method of controlling a feeding apparatus that performs an air blowing operation on sheets so as to separate the sheets from each other by a separation unit, and then feeds the sheets on which the air blowing operation has been performed by a feeding unit brought into contact with the sheets located on a feeding position to which feeding is performed while pressing the sheets from above, the method comprising: performing control so as to stop an air blowing operation from the separation unit such that air blowing by the air blowing operation of the separation unit does not act on the feeding position during a period from a start of feeding by the feeding unit to reaching of the sheets to a conveyance unit when the feeding unit feeds the sheets.

According to another aspect of the present invention, there is provided a method of controlling a feeding apparatus that performs an air blowing operation that can be shielded by a shielding unit on sheets so as to separate the sheets from each other by a separation unit, and then feeds the sheets on which the air blowing operation has been performed by a feeding unit located on a feeding position to which feeding is performed, the method comprising: controlling the shielding unit such that air blowing by the air blowing operation of the separation unit does not act on the feeding position during a period from a start of feeding by the feeding unit to reaching of the sheets to a conveyance unit when the feeding unit feeds the sheets.

Further features of the present invention will become apparent from the following description of exemplary embodiments (with reference to the attached drawings).

DESCRIPTION OF THE EMBODIMENTS

Embodiments of the present invention will be described in detail below with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
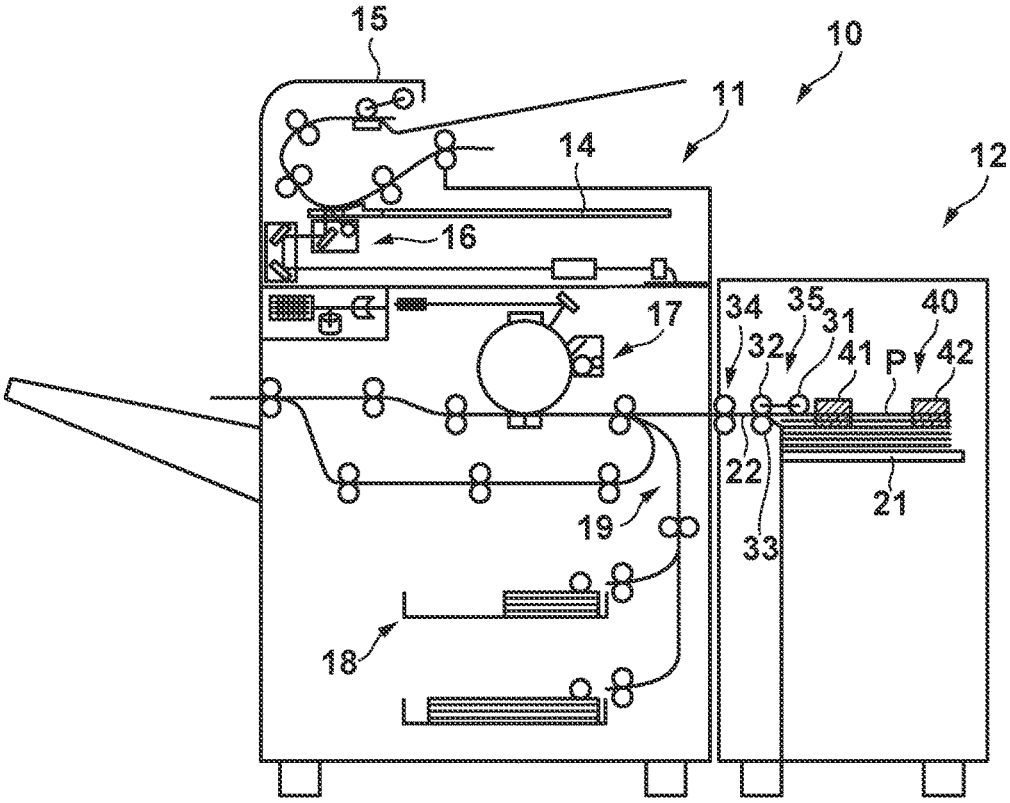
FIG. 1 is a view showing an example of the arrangement of an image formation processing system according to an embodiment.

FIG. 1 is a view showing an example of the arrangement of an image formation processing system 10 according to the embodiment.

In this image formation processing system 10, a feeding apparatus 12 is connected to an image forming apparatus 11. The image forming apparatus 11 includes a reading unit 16 with a platen glass 14 and an ADF (automatic document feeder) 15, an image forming unit 17, and a conveyance unit 19 that feeds and conveys a sheet from an internal feeding cassette 18.

The feeding apparatus 12 can stack a large volume of sheets and continuously supply the sheets to the image forming apparatus 11. This feeding apparatus 12 includes a stack tray (sheet staking unit) 21 that can move vertically while stacking a large volume of sheets P. The image forming apparatus 11 can perform image formation processing on the sheets fed from the feeding apparatus 12 by connecting a sheet conveyance path 22 from this stack tray 21 to the conveyance unit 19 of the image forming apparatus 11.

The feeding apparatus 12 includes the stack tray 21, a feeding roller (pickup roller) 31 that abuts against the uppermost sheet P of a sheet bundle stacked on the stack tray 21, and a separating and feeding unit 35 provided on the upstream side of the sheet conveyance path 22. The feeding roller 31 is provided to be swingable in a direction to approach and a direction to move away from the sheets stacked on the stack tray 21 with a shaft (not shown) as a rotation center. In this embodiment, the feeding roller 31 is arranged to be always biased in the direction to approach the sheets by its own weight. In this embodiment, the sheets stacked on the stack tray 21 rise, and the feeding roller 31 is moved to a feeding position capable of feeding the sheets by the rising sheets against its own weight. The feeding roller 31 may be configured to be swingable by a driving mechanism or the like, and the feeding roller 31 at a retracting position may be configured to move to the feeding position by the driving mechanism as the sheets stacked on the stack tray 21 rise. This feeding apparatus 12 further includes a pair of conveyance rollers 34 provided on the downstream side of the sheet conveyance path 22. The separating and feeding unit 35 includes a feed roller 32 and a retard roller 33, nips the sheets picked up by the feeding roller 31 one by one with the feed roller 32 and the retard roller 33, and conveys them to the pair of conveyance rollers 34.

Figure 6:
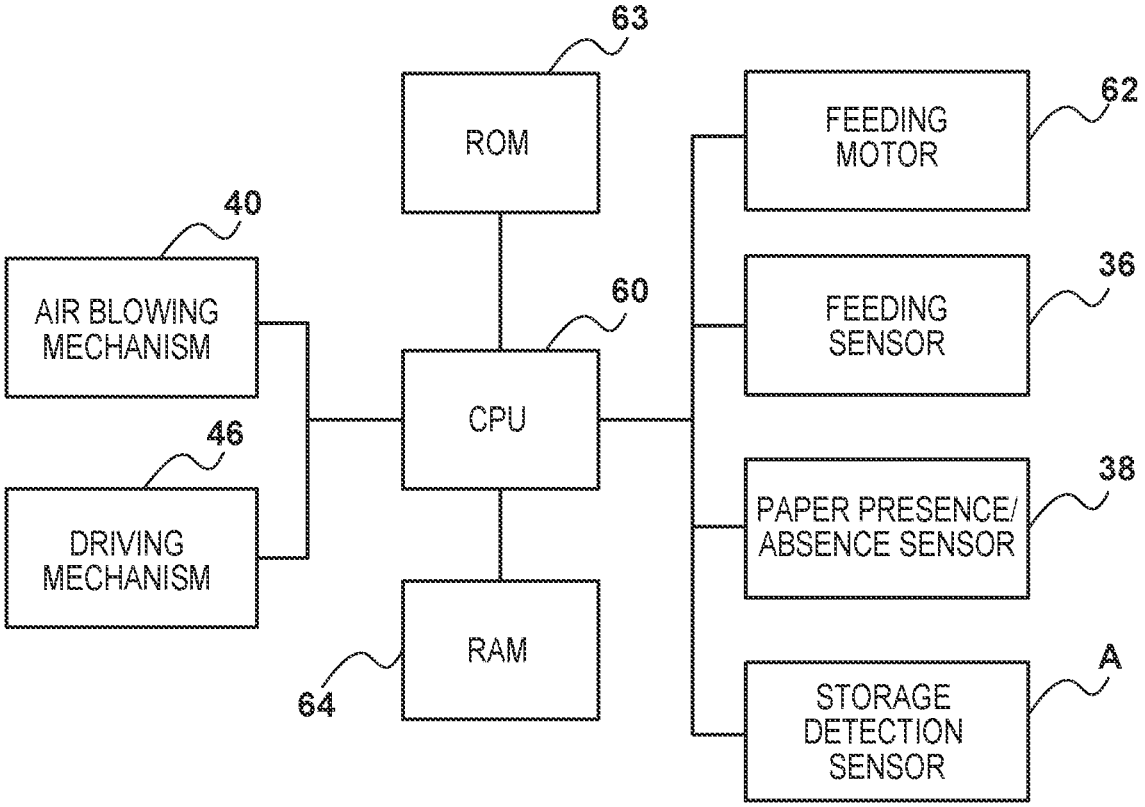
FIG. 6 is a block diagram for explaining the control arrangement of the feeding apparatus according to the embodiment.

Note that the stack tray 21 enters a state in which the uppermost sheet P of the sheet bundle stacked on the stack tray 21 rises to a pickup position to be picked up by the feeding roller 31 and is pressed from above by the weight of the feeding roller 31 at the same time as the feeding apparatus 12 is activated or as a storage detection sensor A shown in FIG. 6 detects that the stack tray 21 is stored in the feeding apparatus 12. Then, the sheets are picked up by rotating the feeding roller 31, separated one by one by the separating and feeding unit 35, and then conveyed to the image forming apparatus 11 by the pair of conveyance rollers 34. This stack tray 21 is controlled such that the uppermost sheet rises to the pickup position each time the feeding roller 31 picks up a predetermined number of sheets.

As described above, a sheet feeding operation is performed by separating the sheets picked up from the top of the stack tray 21 one by one, and the separated sheets are conveyed to the image forming apparatus 11. At this time, double feed in which some sheets overlap each other may occur. This is considered to be influenced by, for example, degradation in separation performance of the separating and feeding unit 35 owing to the wear or the like of the feed roller 32 and the retard roller 33, a change in friction coefficient among the sheets affected by a temperature, a humidity, or the like in the feeding apparatus 12, or tight contact by a cutting burr at a sheet end. If such double feed occurs, the sheets are not conveyed properly, causing a feeding failure.

To cope with this, an air blowing mechanism 40 is arranged on the side-surface side of the sheets fed from the feeding roller 31 to the separating and feeding unit 35, and a predetermined volume of air is blown from there to the side surface of the uppermost sheet of the sheet bundle, canceling a tight contact state among the sheets and separating the sheets easily.

Figure 2:
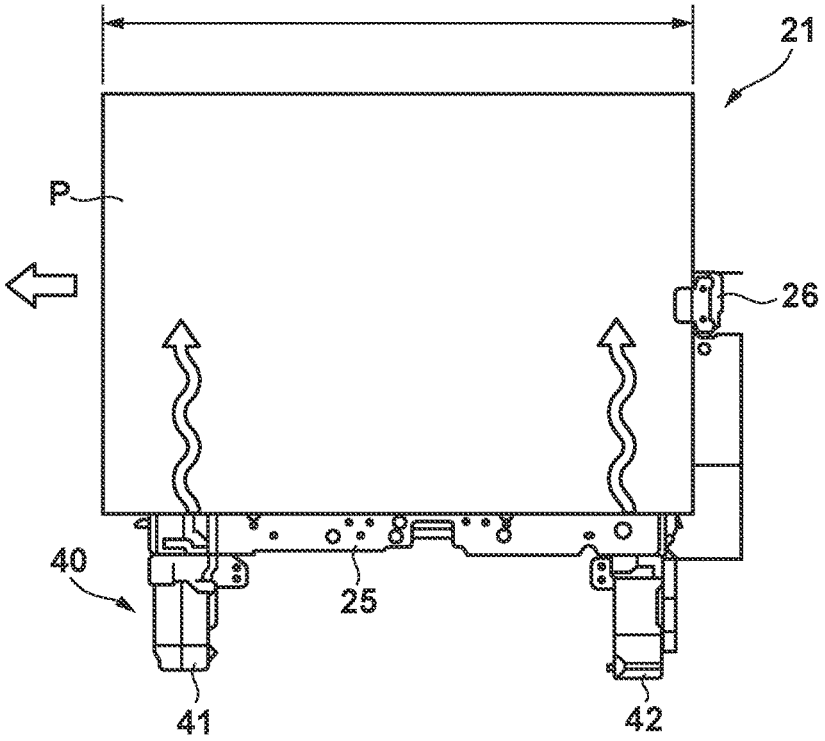
FIG. 2 is a plan view for explaining an air blowing mechanism according to the embodiment.

FIG. 2 is a plan view for explaining the air blowing mechanism 40 according to the embodiment and a view showing the stack tray 21 on which the sheets P are stacked when viewed from above.

The air blowing mechanism 40 includes a first air blowing unit 41 that blows air to the leading edge side (downstream side) of the sheet P conveyed leftward in FIG. 2 and a second air blowing unit 42 that blows air to the trailing edge side (upstream side) of the conveyed sheet P. The air blowing units 41 and 42 blow air by corresponding fans 41*a* and 42*a*. The air blowing mechanism 40 further includes a swing mechanism 45 (FIGS. 3A and 3B) that changes the directions of air from the first air blowing unit 41 and the second air blowing unit 42. This swing mechanism can change an air sending direction to a vertical direction with respect to the sheets. The stack tray 21 regulates the trailing portion of the sheet P having a predetermined size by a trailing edge regulating member 26. The first air blowing unit 41 and the second air blowing unit 42 are fixed to a side surface regulating plate 25 (see FIGS. 3A and 3B) that regulates the side surface of the sheet bundle stacked on the stack tray 21.

Figure 3A:
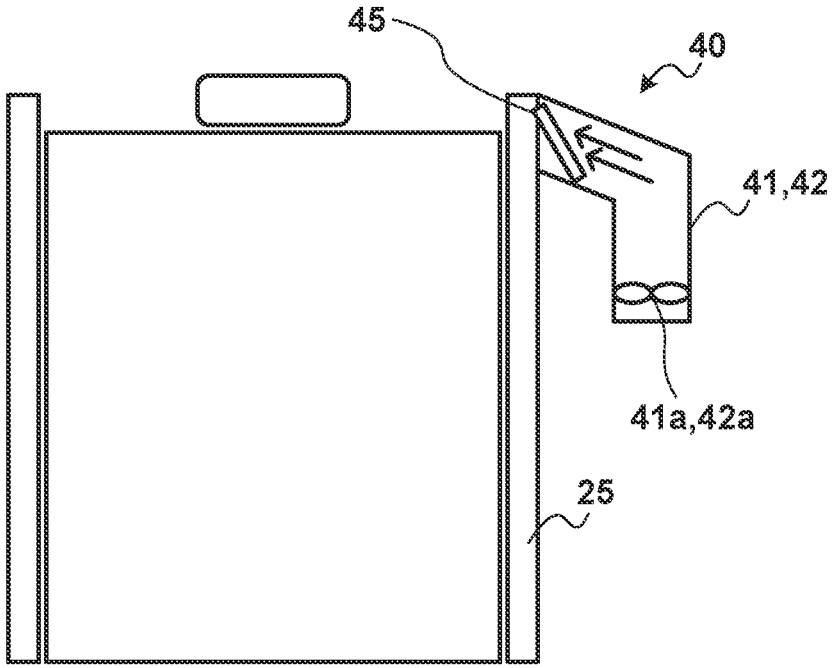
FIGS. 3A and 3B are schematic views each for explaining an operation of the air blowing mechanism according to the embodiment.
Figure 3B:
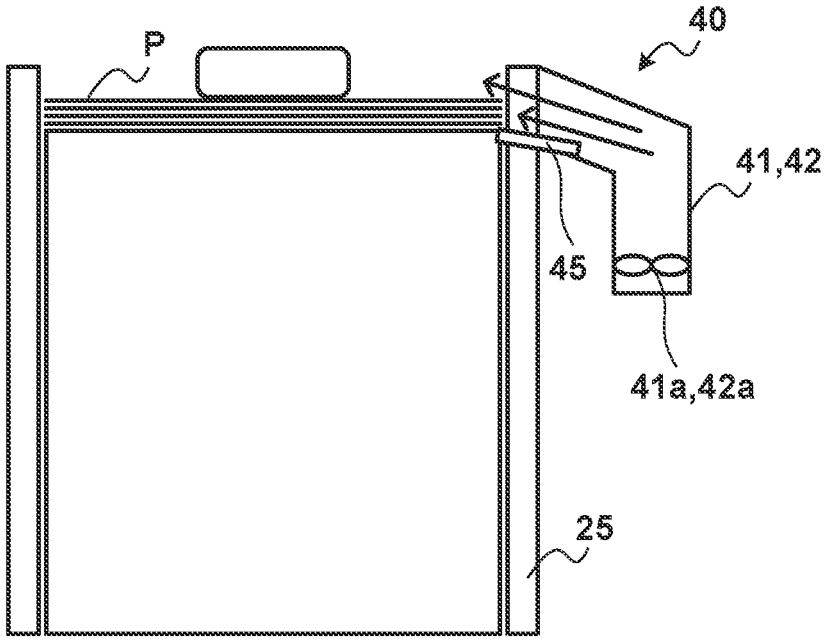

FIGS. 3A and 3B are schematic views each for explaining an operation of the air blowing mechanism 40 according to the embodiment.

Figure 4:
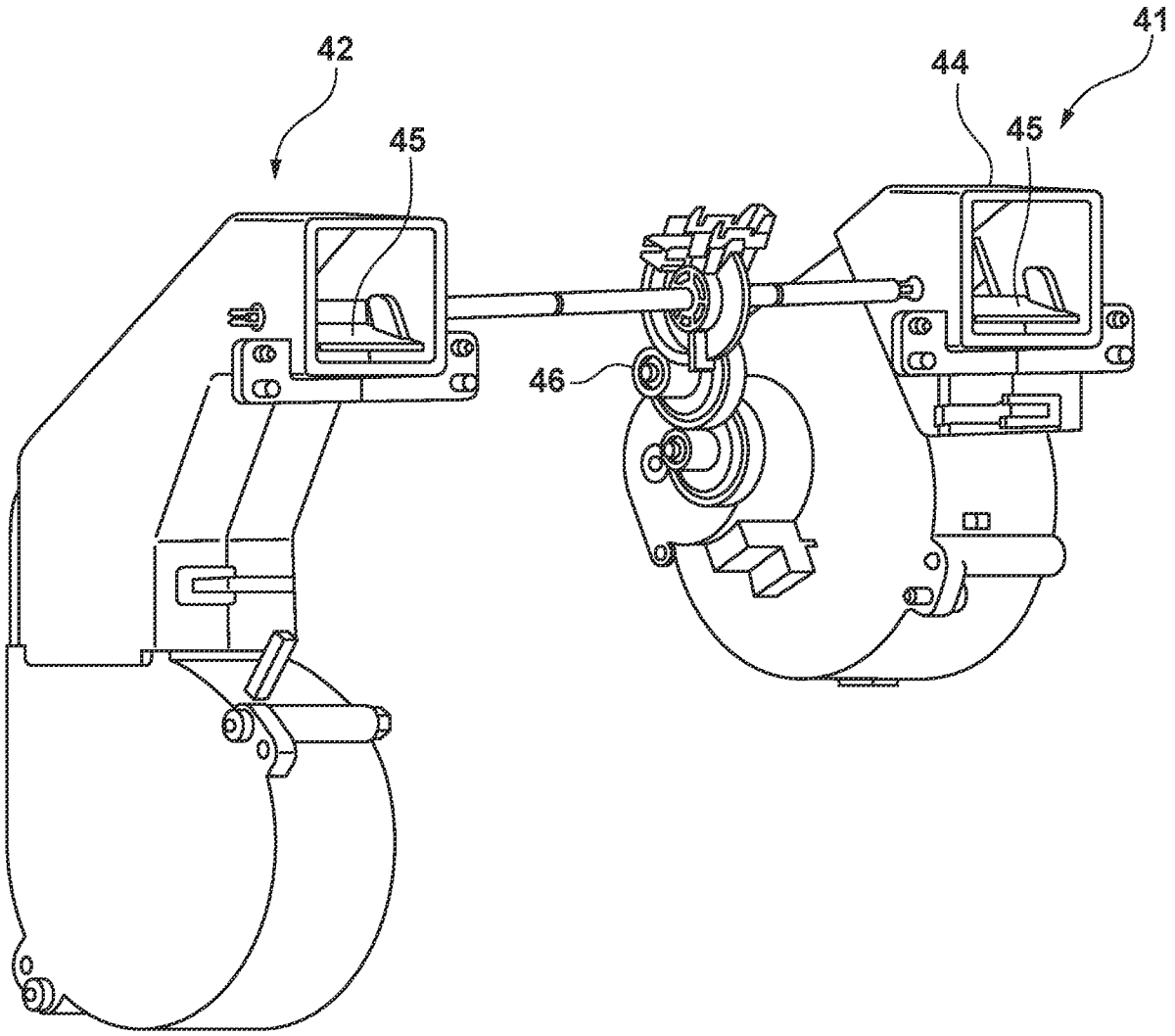
FIG. 4 is a perspective view for explaining swing mechanisms and a driving mechanism thereof according to the embodiment.

The swing mechanisms 45 each changing an air blowing direction are connected to a driving mechanism 46 arranged between the first air blowing unit 41 and the second air blowing unit 42 as shown in FIG. 4, and configured to drive the swing mechanisms 45 vertically.

FIG. 3A shows a state in which the swing mechanism 45 suppresses air sending, and FIG. 3B shows a state in which the swing mechanism 45 blows air to an upper bundle of the stacked sheets P.

FIG. 4 is a perspective view for explaining the swing mechanisms 45 and the driving mechanism 46 thereof according to the embodiment. This FIG. 4 is a view showing the air blowing mechanism 40 when viewed from the back side of FIG. 1.

The swing mechanisms 45 each changing the air blowing direction are moved vertically by the driving mechanism 46 in order to cancel the tight contact state among the sheets before the start of feeding. The driving mechanism 46 is controlled at a timing when sheet feeding starts so as not to expose the sheets to air immediately before sheet feeding starts, stabilizing a sheet operation at the time of sheet conveyance.

Figure 5:
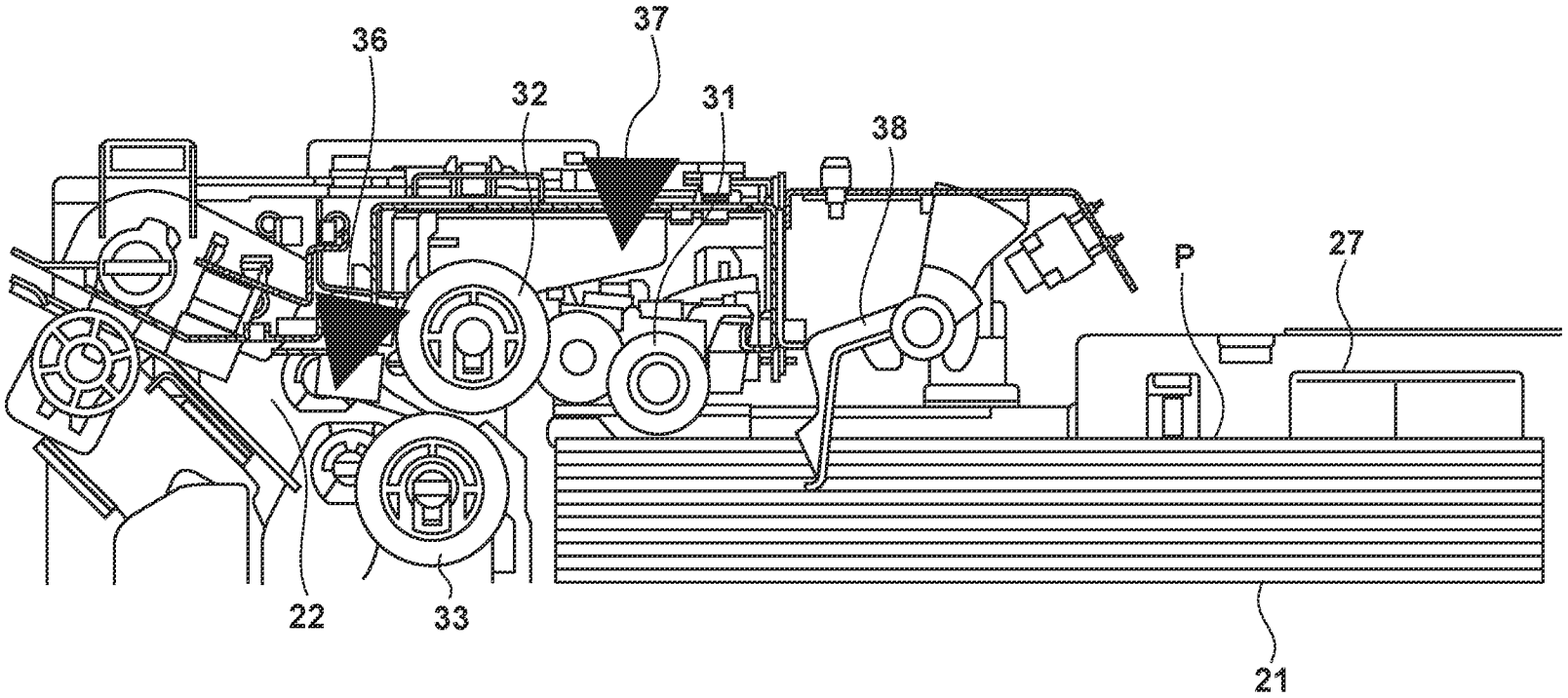
FIG. 5 is a view for explaining a sheet conveyance mechanism in which a feeding apparatus feeds and conveys a sheet according to the embodiment.

FIG. 5 is a view for explaining a sheet conveyance mechanism in which the feeding apparatus 12 feeds and conveys the sheets according to the embodiment.

The side surface of the sheet bundle is exposed to predetermined volumes of air set by input sheet information from the first air blowing unit 41 and the second air blowing unit 42. In order to cancel the tight contact state among the sheets of the sheet bundle here, the predetermined volumes of air are blown to the side surface of the sheet bundle until the feeding roller 31 starts picking up the uppermost sheet on the stack tray 21.

When a paper presence/absence sensor 38 detects a sheet in contact with the uppermost sheet on the stack tray 21, the feeding roller 31 is rotationally driven to pick up the uppermost sheet P. The thus picked up sheets P are separated one by one and conveyed by the feed roller 32 and the retard roller 33. At a timing when the feeding roller 31 picks up the sheets, the first air blowing unit 41 and the second air blowing unit 42 stop blowing air or change the air blowing directions to upward directions by the swing mechanisms 45. FIG. 3A shows this state. By thus controlling them, it is possible to prevent the sheets from fluttering by blowing air when they are fed and improve a conveyance property. Then, when the leading edge of a sheet that has passed through the feed roller 32 and the retard roller 33 reaches a feeding sensor 36 on the sheet conveyance path 22, it can be determined that the sheet reliably reaches a nip area between the feed roller 32 and the retard roller 33. Therefore, the swing mechanisms 45 change air sending directions from the first air blowing unit 41 and the second air blowing unit 42 to downward directions. That is, the swing mechanisms 45 change the directions to the downward directions so as to blow air to the side surface of the sheet bundle. Thus, the predetermined volumes of air are blown to the side surface of the sheet bundle from the first air blowing unit 41 and the second air blowing unit 42 in this state to cancel the tight contact state among the sheets and prepare for succeeding sheet conveyance. Note that the position of the feeding sensor 36 can be a position from the upstream end of the nip area between the feed roller 32 and the retard roller 33 in a conveyance direction. By thus performing control so as to make the air volumes with respect to the sheets smaller than before the start of pickup during a period from the start of pickup by the feeding roller 31 to detection of the sheets by the feeding sensor 36, separation by air can be performed in preparation for the succeeding sheet conveyance in a state in which the sheet is nipped by the feed roller 32 and the retard roller 33 provided on the downstream side of the feeding roller 31. It is therefore unnecessary to wait for completion of sheet feeding. That is, it is possible to quickly improve the separation property of the succeeding sheet while preventing the sheets from fluttering by blowing air when they are fed.

Each of the first air blowing unit 41 and the second air blowing unit 42 includes an outlet 44 facing a ventilating window 27 (FIG. 5) provided in the side surface regulating plate 25 and an air blowing fan (not shown) that generates air toward this outlet 44. A heater (not shown) is provided between the outlet 44 and the air blowing fan, making it possible to blow air heated to a predetermined temperature from the outlet 44 to the side surfaces of the sheets via the ventilating window 27. Note that it is possible to change the rotation speed (air volume) of this air blowing fan, and it is also possible to set the heater at an arbitrary temperature.

The stack tray 21 regulates the trailing portion of each sheet P having the predetermined size by the trailing edge regulating member 26 and rises to a height at which the uppermost sheet P of the sheet bundle contacts the feeding roller 31 by an elevating mechanism when stored in the feeding apparatus 12. At this time, the heater of each of the first air blowing unit 41 and the second air blowing unit 42 is heated to a predetermined temperature, and the air blowing fan blows dry air from the outlet to the leading edge side and trailing edge side of each sheet via the ventilating window 27. Note that the set temperature of the heater and the rotation speed of the air blowing fan are set appropriately in accordance with the installation environment of the feeding apparatus 12.

The first air blowing unit 41 and the second air blowing unit 42 thus blow air to the upstream side and downstream side of each sheet simultaneously, making it possible to cancel the tight contact state among the sheets of the sheet bundle stacked on the stack tray 21, and prevent the feeding failure such as double feed in advance.

FIG. 6 is a block diagram for explaining the control arrangement of the feeding apparatus 12 according to the embodiment.

A CPU 60 controls the operation of this feeding apparatus 12. The CPU 60 controls, for example, the aforementioned air blowing mechanism 40 and driving mechanism 46, and a feeding motor 62. In addition, the CPU 60 inputs sensor signals from the feeding sensor 36 and the paper presence/absence sensor 38, and detects the state of the sheets on the stack tray 21 and the state of the sheets being conveyed.

The CPU 60 executes programs stored in a ROM 63 and performs processing to be described with reference to FIG. 7. A RAM 64 is used as a work area of the CPU 60 and temporarily saves various kinds of data.

When the storage detection sensor A detects that the stack tray 21 is stored in the feeding apparatus 12, the CPU 60 performs control so as to drive the air blowing mechanism 40 to blow a predetermined volume of air to the side surface of the uppermost sheet P of the sheet bundle. Then, upon receiving a signal to start sheet conveyance, the CPU 60 drives the feeding motor 62 to rotate the feeding roller 31 and starts conveying the uppermost sheet P stacked on the stack tray 21. In addition to this, the CPU 60 controls the driving mechanism 46 so as to turn the air blowing directions upward by the swing mechanisms 45, that is, so as not to expose the sheet P to air. Upon detecting that the leading edge of each sheet P conveyed by the feeding roller 31 by rotationally driving the feeding motor 62 reaches the feeding sensor 36 on the sheet conveyance path 22, the CPU 60 further controls the driving mechanism 46 so as to turn the air blowing directions downward by the swing mechanisms 45. Thus, when a preceding sheet is conveyed, and its leading edge reaches the feeding sensor 36, the sheet bundle is exposed to air to prepare for succeeding sheet conveyance.

Figure 7:
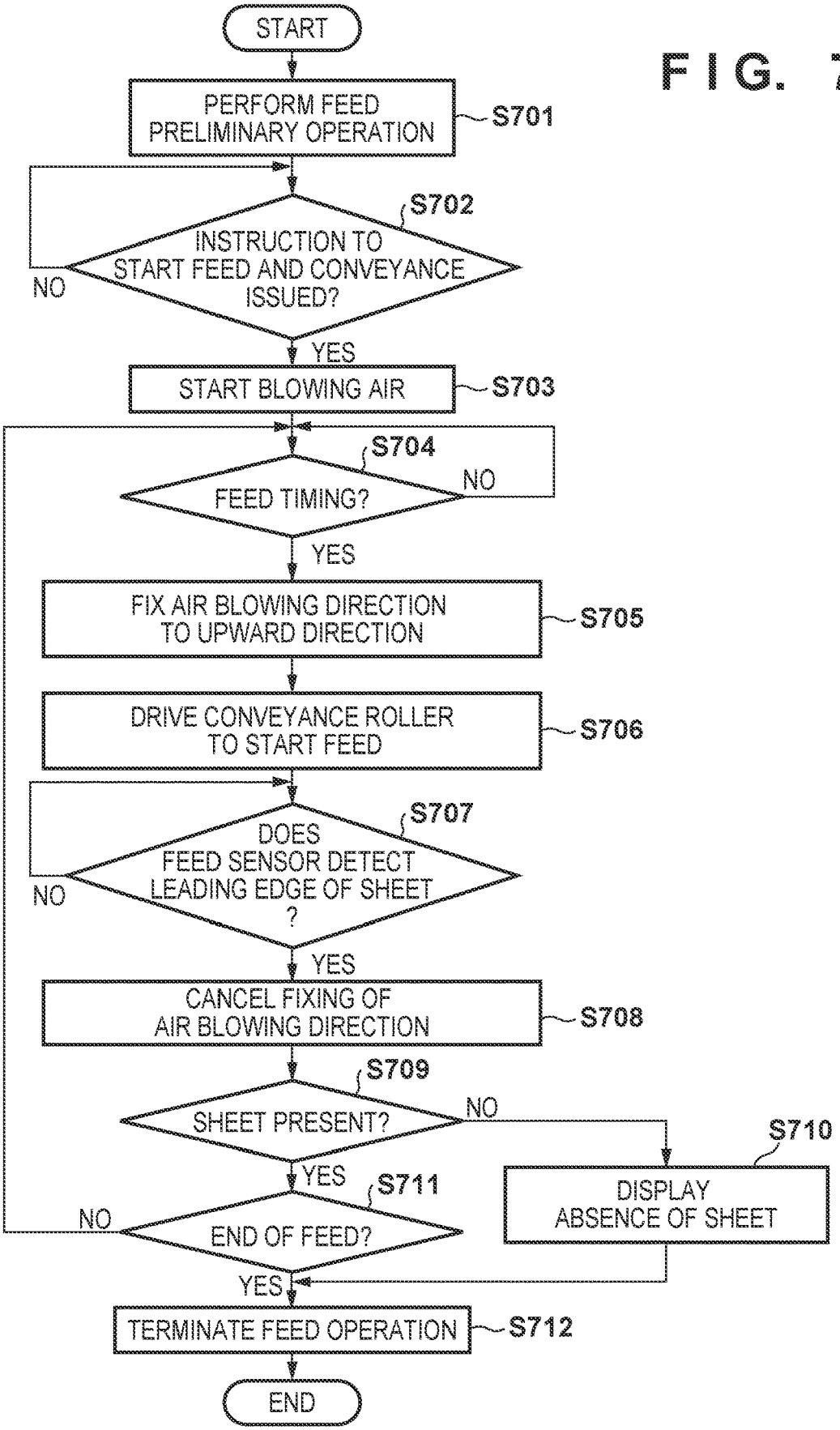
FIG. 7 is a flowchart for explaining control processing by a CPU of the feeding apparatus according to the embodiment.

FIG. 7 is a flowchart for explaining control processing by the CPU 60 of the feeding apparatus 12 according to the embodiment.

This processing is started when the feeding apparatus 12 is activated or the storage detection sensor A detects that the stack tray 21 is stored in the feeding apparatus 12. First, in step S701, the CPU 60 starts a preliminary operation to feed sheets. This preliminary operation is an operation of raising the stack tray 21 so that the uppermost sheet is positioned at a feeding position, driving the air blowing mechanism 40 to blow air to the side surface of the uppermost sheet of a sheet bundle during a predetermined time, and then stopping blowing the air. Next, in step S702, the CPU 60 waits for the input of a signal to start feeding and conveyance, when the signal is input, detects it as an instruction to start feed and conveyance, and advances the process to step S703. In step S703, the CPU 60 drives the air blowing mechanism 40 to start blowing a predetermined volume of air to the side surface of the uppermost sheet of the sheet bundle. At this time, the driving mechanism 46 drives the swing mechanisms 45 to turn the air blowing directions upward and downward. Next, the process advances to step S704. If the CPU 60 determines that it is a feed timing, the process advances to step S705 in which the CPU 60 controls the driving mechanism 46 so as to fix the directions of air blown out of the air blowing mechanisms 40 to the upward directions by the swing mechanisms 45. Then, the process advances to step S706 in which the CPU 60 starts picking up the uppermost sheet of the sheet bundle stacked on the stack tray 21 by rotationally driving the feeding roller 31. It is only necessary here that the uppermost sheet of the sheet bundle is not exposed to the air blown out of the air blowing mechanisms 40, and thus the present invention is not limited to this operation. For example, an operation of stopping driving the air blowing fan, closing the outlet 44, or the like may be performed.

Next, the process advances to step S707 in which the CPU 60 determines whether the feeding sensor 36 detects the leading edge of each conveyed sheet P and advances the process to step S708 when the leading edge of the sheet P is detected. In step S708, the CPU 60 performs control so as to cancel fixing of the directions of the air blown out of the air blowing mechanisms 40 by the swing mechanisms 45, that is, so as to send the predetermined volumes of air to the side surface of the uppermost sheet of the sheet bundle. The tight contact state among the sheets of the sheet bundle is thus canceled in order to convey the succeeding sheet, and the process advances to step S709 to prepare for succeeding sheet conveyance.

In step S709, the CPU 60 determines, based on the signal of the paper presence/absence sensor 38, whether the sheets are stacked on the stack tray 21, advances the process to step S710 if it determines that there is no sheet on the stack tray 21, notifies a user to replenish sheets, advances the process to step S712 to terminate a feed operation, and terminates this processing. On the other hand, if the CPU 60 determines that there are the sheets on the stack tray 21, the process advances to step S711. The CPU 60 determines in step S711 whether feeding is complete. When feeding is not complete, the process returns to step S704 to perform the aforementioned processing. On the other hand, if the CPU 60 determines in step S711 that sheet feeding is complete, the process advances to step S712 in which the feeding operation is complete, terminating this processing. Thus, operations from step S704 to step S711 are performed repeatedly until feeding of the designated number of sheets is complete.

(Another Modification)

In the above-described embodiment, the swing mechanisms 45 control the air directions. However, the present invention is not limited to this.

Note that in the above-described embodiment, when air is not blown to the side surfaces of the sheets on the stack tray 21, the air sending directions are changed so as not to expose the side surfaces to the air. However, the present invention is not limited to this. It is only necessary that the influence of the air on the feeding position to which the sheets are fed at the time of feeding is smaller than at least before the start of feeding, and air blowing by the air blowing mechanism may be stopped. That is, the rotation of the air blowing fan may be stopped. Furthermore, a member such as a shutter that shields air may be provided.

When a plurality of air blowing mechanisms exist, driving of an air blowing mechanism closest to the feeding position to which the sheets are fed may be controlled to reduce the influence of the air on the sheets to be fed after feeding is started.

Note that in the above embodiment, the description has been given by taking the feeding apparatus as an example. However, the present invention is also applicable to an image forming apparatus such as a printing apparatus that includes such a feeding apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2017-032506, filed Feb. 23, 2017, and 2018-018507, filed Feb. 5, 2018, which are hereby incorporated by reference herein in their entirety.

What is claimed is:

1. A feeding apparatus comprising:

a stacking unit for stacking sheets;

a blower unit for blowing air to a side of the sheets stacked on the stacking unit;

a direction changing unit for changing a direction of the air blown by the blower unit, wherein the direction changing unit and the blower unit are able to perform a first air blowing operation blowing air to a side of the sheets in a first blowing direction and a second air blowing operation blowing air to the side of the sheets in a second blowing direction, the second blowing direction being more upward with respect to the first blowing direction, and a volume of air blowing to the side of the sheets in the second air blowing operation being smaller than a volume of air blowing to the side of the sheets in the first air blowing operation;

a feeding unit, brought into contact with a sheet stacked on the stacking unit and located at a feeding position at which feeding is performed while pressing the sheet from above, for feeding the sheet on which the first air blowing operation has been performed;

a conveyance unit, provided on a downstream side of the feeding unit in a feeding direction, for conveying the sheet fed by the feeding unit using a nip formed between a pair of rollers;

a detection unit configured to detect a leading edge of the sheet at a downstream side of the nip in the feeding direction; and a control unit for controlling the direction changing unit to change, after starting the first air blowing operation and before starting feeding of the sheet by the feeding unit, from the first air blowing operation to the second air blowing operation, and then change, on the basis of detection of the leading edge of the sheet by the detection unit, from the second air blowing operation to the first air blowing operation.

2. The feeding apparatus according to claim 1, wherein the blower unit includes:

a plurality of air blowing fans provided at different positions in the feeding direction and configured to blow air to the sheets.

3. The feeding apparatus according to claim 1, wherein the feeding unit includes a rotation member configured to feed the sheet, and rotation of the rotation member is started when the sheet stacked on the stacking unit is fed.

4. The feeding apparatus according to claim 1, wherein the blower unit includes a plurality of air blowing fans, and wherein the direction changing unit changes the direction of air blown by an air blowing fan closest to the feeding unit out of the plurality of the air blowing fans.

5. A feeding method for feeding a sheet stacked on a stacking unit to a conveyance unit that conveys the sheet using a nip formed between a pair of rollers, comprising:

a first air blowing step of performing, to a side of sheets stacked on the stacking unit, a first air blowing operation blowing air in a first blowing direction by using a blower unit and a direction changing unit;

a feeding step of feeding the sheet in a feeding direction from a feeding unit to the nip;

a second air blowing step of changing by a control unit, after starting the first air blowing operation and before starting feeding of the sheet by the feeding unit, from the first air blowing operation to a second air blowing operation blowing air to the side of the sheets in a second blowing direction by using the blower unit and the direction changing unit, the second blowing direction being more upward with respect to the first blowing direction, and a volume of air blowing to the side of the sheets in the second air blowing operation being smaller than a volume of air blowing to the side of the sheets in the first air blowing operation;

a detecting step of detecting a leading edge of the sheet by a detection unit at a downstream side of the nip in the feeding direction; and a changing step of changing, by the control unit, on the basis of detection of the leading edge of the sheet by the detection unit, the direction changing unit from the second air blowing operation to the first air blowing operation.

6. The feeding apparatus according to claim 1, wherein a distance between the detection unit and the nip is shorter than a length of the sheet in the feeding direction.

7. The feeding apparatus according to claim 1, wherein the control unit controls the direction changing unit so as to change from the second air blowing operation to the first air blowing operation while the sheet is passing through the nip.

8. The feeding apparatus according to claim 1, wherein the control unit controls the direction changing unit so as to change, when the feeding unit starts the feeding operation, from the first blowing operation to the second blowing operation.

9. The feeding apparatus according to claim 1, wherein a volume of air blowing by the blower unit is constant when performing the first air blowing operation and the second air blowing operation.

* * * * *